United States Patent [19]

Bogner

[11] 4,290,068

[45] Sep. 15, 1981

[54] MICROWAVE TELEVISION SYSTEM

[76] Inventor: Richard D. Bogner, 4 Hunters La., Roslyn, N.Y. 11576

[21] Appl. No.: 103,612

[22] Filed: Dec. 14, 1979

[51] Int. Cl.[3] ..... H01Q 13/28

[52] U.S. Cl. ..... 343/702; 343/785; 343/753; 455/281

[58] Field of Search ..... 343/785, 701, 702, 819, 343/753; 455/131, 281, 282, 293

[56] References Cited

U.S. PATENT DOCUMENTS

| | | | |
|---|---|---|---|
| 3,389,394 | 6/1968 | Lewis | 343/785 |
| 3,806,942 | 4/1974 | Preti | 343/785 |
| 4,053,897 | 10/1977 | Nerheim | 343/785 |
| 4,197,546 | 4/1980 | Cachier et al. | 343/785 |

*Primary Examiner*—Eli Lieberman
*Attorney, Agent, or Firm*—Leonard H. King

[57] ABSTRACT

A microwave television system comprising, a probe excited waveguide, an electronics circuit package contained within the waveguide, and a support for mounting the waveguide. The probe excited waveguide is an open-end waveguide which can be used as an independent antenna or a launcher for an end fire radiator, and which achieves a higher gain than conventional waveguides without an increase in size. The waveguide is formed of an elongated metallic container and includes a metal structure positioned within the container spaced from the side walls of the container and located within one half of the volume of the container, this volume being defined by cutting the cylinder along its elongated axis. A probe extends from the metal structure into the other half of the container for excitation of the waveguide. The electronics package conventionally utilized in conjunction with the waveguide can be positioned in the container beneath the metal structure. The electronics package does not interfere with the operation of the antenna. The antenna achieves higher gain as a result of the presence of the metal structure. In one embodiment the electronics package comprises a down-converter which receives for example a 2 GHz signal containing information, amplifies and then converts it to a signal at a frequency employed by conventional television receivers, i.e. for displaying the information on the receiver.

14 Claims, 11 Drawing Figures

MICROWAVE TELEVISION SYSTEM

BACKGROUND OF THE INVENTION

This invention relates to microwave television systems including an antenna with appropriate electronic circuitry, and more particularly to a probe excited waveguide used as the antenna with the electronics contained directly within the waveguide.

Antennas in conjunction with appropriate electronic circuitry are utilized for both transmission and receiving of television signals. Most recently the MDS (Multipoint Distribution Systems) type of communications has been experiencing continuous growth. Such systems have been associated with pay television for transmission of movies, special programs, as well as for teaching purposes. The benefit of the MDS system is that a single receiver could be utilized for a number of locations with the output being distributed to each location. This is convenient for apartment houses, as well as homes in a development at a remote location from the source. The typical MDS system includes the transmitter, the program source, and the receiving system.

At the MDS transmitter there is provided an up-converter-amplifier driven by an exciter whose output is transmitted by an antenna. The exciter section can accept video and audio from any number of sources such as an earth sattelite receiver or studio equipment. The output of the modulator is a standard television signal. The frequency alloted to MDS transmission is approximately 2 GHz.

At the receiver, there is again employed an antenna for receiving the signal, a down-converter to lower the frequency of the MDS signal to a frequency that can be easily amplified and distributed to the MDS subscribers and a television receiver for displaying the received signal. Additional circuitry is also frequently included at the receiver end including a pre-selector, a pre-amplifier, as well as an IF amplifier.

Generally, the type of antennas that are recommended for use with an MDS system are the dish antenna, the corner reflector or the yagi. The requirement for a suitable antenna are that it achieve relatively high gain, and high directivity over a large frequency band. At the same time, the cost of the antenna is a critical factor, especially where the cost of the total installation is of importance as for private home installations.

One type of antenna which has achieved relatively high gain, high directivity over a large frequency band, and has nevertheless been available at low cost, is the disc-on-rod type antenna, excited by a launcher or elementary antenna. Such disc-on-rod type antenna has been described in my prior U.S. Pat. No. 2,955,287, issued on Oct. 4, 1960, and in my U.S. Pat. No. 3,015,821 issued on Jan. 2, 1962. In those patents, both of which are herein incorporated by reference, there is described an end fire radiator having a principal axis adapted to be energized by a launcher at its non radiating end for the transmission of energy of a desired wavelength in the direction of the axis. The electrically active components of the radiator consist of a plurality of substantially identical electrically conductive plates having a major dimension greater than $\lambda/4$ and less than $\lambda/2$ and spaced from each other a distance between $\lambda/8$ and $\lambda/2$, wherein $\lambda$ is the wavelength of the energy. The plane of the plates are normal to the axis to thereby form an elongated radiator.

A further modification of the basic disc-on-rod type of antenna is described in my prior U.S. Pat. No. 3,440,658 issued on Apr. 22, 1969 and also incorporated herein by reference. In that patent, there is described a combination type antenna including the disc-on-rod antenna in conjunction with a second antenna, the combination of which provides a broad-band, high gain antenna suitable for various types of television applications.

The disc-on-rod type antenna can have the discs spaced from each other over a wide range of values and can also be of a size covering a wide range. However, in my copending application Ser. No. 938,883, filed on Sept. 1, 1978, and also incorporated herein by reference, there is described a disc-on-rod end-fire antenna having a particular unique smaller range within the general larger range recited in the aforementioned issued patents, in order to provide a significant improvement. In particular, there is employed an end-fire radiator of a length between three times the wavelength and twelve times the wavelength, having a principal axis adapted to be energized by a launcher at its non-radiating end for the transmission of energy of a desired wavelength in the direction of the axis. The electrically active components of the radiator consist of the plurality of substantially identical thin electrically conductive plates spaced between 0.16 and 0.20 times the wavelength along the axis. The plane of the plates are normal to the axis and the difference between the diameter of the plates and the diameter of the supporting rod is greater than 0.23 times the wavelength and less than 0.27 times the wavelength.

In each of the aforementioned types of disc-on-rod antennas, a launcher is utilized to excite the antenna array. Usually, the launcher itself is an elementary antenna of the probe excited open-end waveguide type. More specifically, the launcher generally is formed of a metallic container having a closed back, side walls and an open mouth. A probe, usually formed of a coaxial transmission line, extends into the waveguide container through one of its walls. The probe serves to excite the launcher along the axis of the container. The disc-on-rod end fire radiator is connected along the principal axis of the launcher and is energized by the launcher to the particular energy wavelength. While such elementary antennas are useful as a launcher for the disc-on-rod type antenna, they can actually be utilized independently as a probe excited open-end waveguide for the transmission of energy by themselves.

In both the disc-on-rod type antenna, as well as the elementary antenna itself, additional electronic circuits are of course required to utilize the antenna for actual reception or transmission. For example, a preamplifier, a down converter, etc. would be needed in conjunction with the antenna in order to utilize it in practice. Such electronic circuits are generally contained within a package in a separate housing positioned in an external location relative to the antenna. Generally, the antenna is mounted on a pole and is subject to wind loading. The electronics package with its own housing is also mounted on the pole. The electronics is connected to the antenna by means of a coaxial cable. In order to eliminate losses, the coaxial connection between the electronics package and the antenna is kept as short as possible. Thus, with two separate housings, specifically the antenna itself, and the separate electronics package housing, there exists additional problems since now there are two housings which are subject to wind load, external environmental damage, excessive weight on the support, packaging and shipping problems. etc.

In connection with MDS type systems, there is special difficulty in connection with the installation of the antenna and the separate electronics housing. The transmitted signal is subject to losses due to interferences from the topology of the area as well as from buildings, and structures. It is therefore necessary to thoroughly survey each site prior to installation of the antenna. A suitable site must be selected which is free of path barriers such as mountains, or high ridges, as well as intervening building structures. Frequently, numerous locations must be tested before a single receiving antenna can be installed. Such installation may then be made utilizing various types of supports such as chimneys, masts, telephone poles, tripods, etc. Since the electronics package is provided separate from and in spaced relationship with the antenna, a separate mounting must be provided for the electronics package in addition to mounting of the antenna. This results in additional cost and difficulty in providing installation of both the antenna housing as well as the electronics package housing.

Furthermore, especially in MDS type systems, the height of the antenna is a critical factor in achieving proper reception. In many cases, the antenna is raised in height in order to increase the signal level received. However, with increased height above the building on which it is located, there is increased wind effecting the antenna and increased susceptibility to environmental damage. With the presence of a separate housing for the electronics package, the antenna system suffers from greater wind loss and greater susceptibility to external environmental damage.

SUMMARY OF THE INVENTION

Accordingly, it is an object of the present invention to provide an improved microwave television system which avoids the aforementioned problems of prior art devices.

Yet a further object of the present invention is to provide an improved microwave television system suitable for MDS transmission or reception.

Still a further object of the present invention is to provide an improved microwave television system having an antenna with the electronics package both contained within a single housing.

An additional object of the present invention is to provide a microwave television system wherein the down-converter is included within the receiving antenna waveguide.

A further object of the present invention is to provide a microwave television system wherein the up-converter is included within the transmitting antenna housing.

Yet another object of the present invention is to provide an improved antenna which avoids the aforementioned problems of prior art antennas.

Still a further object of the present invention is to provide a probe excited, waveguide which avoids the aforementioned problems of prior art devices.

Yet another object of the present invention is to provide a disc-on-rod end-fire antenna, excited by a launcher which avoids the aforementioned problems of prior art devices.

Still another object of the present invention is to provide a probe excited waveguide which can be used by itself or as a launcher for a disc-on-rod end-fire antenna, and which achieved higher gain than prior devices without an increase in size.

Another object of the present invention is to provide a probe excited open end-waveguide antenna, which can be utilized by itself or as a launcher for a disc-on-rod end-fire antenna, and wherein the electronics package associated with the antenna can be placed within the antenna housing itself.

Yet a further object of the present invention is to provide a probe excited open-end waveguide which can be used as an antenna by itself or as a launcher for a plate-on-rod end-fire antenna, which comprises a metallic container having an open mouth with a metal structure positioned within the container which improves the gain of the antenna and which can be utilized as a support for the electronics package whereby the electronics can be placed directly within the waveguide container itself.

Briefly, the invention provides for a microwave television system having a waveguide, an electronics package within the waveguide, and a support for the waveguide. The waveguide is formed of a metallic container having an elongated axis, and including at least a back wall, side walls and an open mouth which defines an internal cavity. A probe extends into the cavity for excitation of the waveguide. A metal structure is positioned within the cavity extending in a direction from the back wall to the mouth of the container, and is contained within one half of the volume of the cavity, which volume is formed by cutting the container along its elongated axis.

The structure thus formed can be utilized independently as a probe excited open-end waveguide. Alternately, it can be utilized as a launcher at the non-radiating end of a plate-on-rod end-fire antenna. The plate-on-rod antenna is coupled to the mouth of the container such that the metal structure placed inside the cavity can be utilized as the housing for an electronics package. In this manner the electronics package is placed directly within the waveguide cavity and a separate housing for the package is eliminated. As a result, the usual problems of the wind load on the separate electronic package housing is eliminated. Furthermore, since the need for a second housing for the electronics package is eliminated, there is less weight to the antenna both in connection with shipping the antenna as well as placing it on a support during use. Additionally, since the electronics package can be placed directly in the metallic container forming the waveguide, the usual losses resulting from coaxial cables connecting the antenna to the electronics package are thereby completely eliminated.

In addition to obtaining the benefit of maintaining the electronics package directly within the waveguide, a most unusual and unexpected results occurs. It would have been expected that the benefit of maintaining the electronics package in the waveguide housing would have been at the expense of the antenna gain. It might have been hypothesized that the electronics package would interfere with the energy transmitted by the waveguide so as to cause back radiation in the opposite direction to thereby reduce the gain, or, at the very least, to introduce complex modes of transmission thereby avoiding reducing the launching efficiency.

On the contrary, instead of having the electronics package and the metal structure deteriorate the efficiency of the probe excited open-end waveguide, an unusual result occurs in that a somewhat higher gain is actually achieved from the antenna without increasing its size. The higher gain is achieved by the presence of the metal structure itself positioned within the waveguide, whether the electronics package is included or not. Such improvement in gain occurs both with the probe excited, open-end waveguide is used as an elementary antenna itself, or more especially when used as a launcher for a disc-on-rod radiator.

Accordingly, the present invention provides for such probe excited open-end waveguide, having a metal plate or container within the waveguide cavity in order to achieve the improved gain. The electronics package will also be directly included within the waveguide, and specifically within or under the metal plate or container. In the case of an MDS transmitting antenna, the up-coverter would be directly included within the waveguide housing. In the case of the MDS type receiving antenna, the down-converter would be included directly in the waveguide housing. However, other additional electronics could also be included as are needed, as for example, a preselector, a preamplifier, as well as the IF amplifier. All of these electronic circuits can be placed within a single package and placed directly within the housing of the waveguide. This avoids the necessity for any separate housing for the electronics and avoids the necessity of mounting two structures on a support mast. An improved exciting probe is also provided which prevents the benefits of a large probe while maintaining a low mass.

The aforementioned objects, features and advantages of the invention, will, in part, be pointed out with particularity, and will, in part, become obvious from the following more detailed description of the invention taken in conjunction with the accompanying drawing, which forms an integral part thereof.

BRIEF DESCRIPTION OF THE DRAWING

In the drawings.

In the various figures of the drawing, like reference characters designate like parts.

DESCRIPTION OF THE PREFERRED EMBODIMENT

Figure 1:
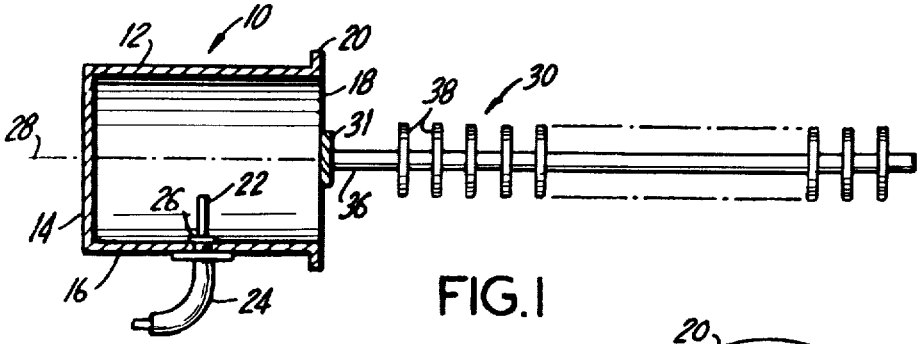
FIG. 1 is a sectional side elevational view of the disc-on-rod antenna of the prior art, using a waveguide launcher.
Figure 2:
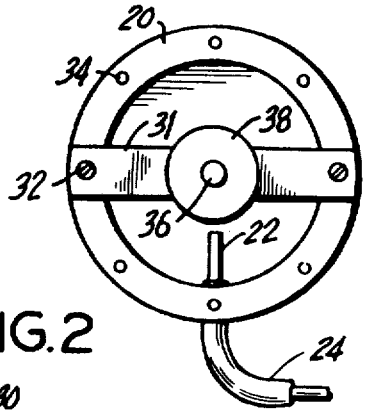
FIG. 2 is an end view of the antenna described in FIG. 1.
Figure 3:
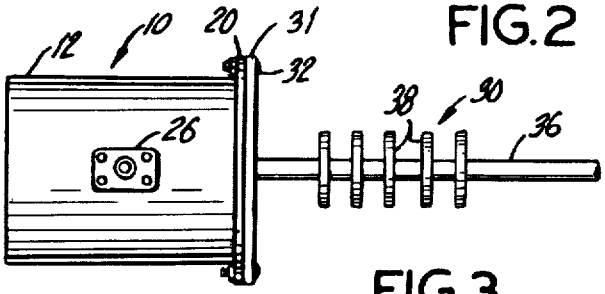
FIG. 3 is a bottom plan view of the antenna shown in FIG. 1.

Referring now to FIGS. 1-3, there is shown a disc-on-rod type antenna of the prior art, as was described in the aforementioned patents and pending application.

More particularly, there is shown a waveguide section 10 which includes a cylindrical container 12 having a closed back 14, side walls 16, and an open mouth 18. A peripheral lip 20 is contained around the open mouth. The waveguide section 10 is excited by means of a probe 22 formed from the center portion of a coaxial line 24 connected through a side wall 16 by means of a standard coupling connector 26. The coaxial cable extends from the waveguide section 10 to appropriate electronic circuitry. The waveguide section 10 propagates a signal which is polarized in a direction parallel to the probe. As shown with a vertical probe, a vertically polarized signal would result along the axis 28.

The waveguide section 10 can be utilized independently as an elementary antenna, or it can be utilized as the launcher for a disc-on-rod radiator. As shown, a disc-on-rod array 30 is connected to the waveguide section 10 by means of a support member 31 which is a metal bar secured to the peripheral lip 20 by means of nuts and bolts 32 positioned in an appropriate ones of the many holes 34 provided in the peripheral lip 20.

The support member 31 is positioned transverse to the probe 22 so as not to interfer with the signal being transmitted. If it would be desired to transmit a horizontally polarized signal, the probe would be oriented 90° from the position shown, and more particularly in a horizontal direction, and the support bar 31 would be placed vertically. If 31 were non-metallic, any orientation would be acceptable.

Extending from the support bar 31 is a disc-on-rod radiator which comprises the axial rod 36 and transversely spaced apart discs 38. Although one rod section is shown, it is understood that each rod could terminate in a coupling adapted to receive additional successive sections.

As was explained in the aforementioned pending applications the discs should have a diameter greater than $\lambda/4$ and less then $\lambda/2$ and a spacing between $\lambda/8$ and $\lambda/2$. However, as described in the aforementioned pending application, by restricting the disc spacing and the diameter of the discs and rod to a specific smaller range, there is a significant improvement obtained. In particular, where the energy is of a wavelength $\lambda$, the end fire radiator is between a length $3\lambda$ and $12\lambda$ having a principal axis adapted to be energized by the launcher, at its non radiating end for the transmission of energy of a desired wavelength in the direction of the axis. The thin electrical conductive discs are spaced between $0.16\lambda$ and $0.2\lambda$ apart along the axis with the plane of the disc normal to the axis. The difference in diameters between the discs and the rod is greater than $0.23\lambda$ and less than $0.27\lambda$.

When such an antenna would be utilized in an MDS installation, the electronics package associated therewith would generally be contained in a separate housing spaced from the antenna. In an MDS receiving system, the down-converter, as well as other circuitry, would all be placed within a separate housing and mounted on the mast adjacent to the antenna.

Generally, the disc-on-rod type antenna is mounted by means of a bracket to a supporting mast generally on the roof of a building. The antenna is therefore subject to heavy winds and experiences detrimental environmental conditions. When the electronic circuitry is contained in a separate housing, apart from the antenna, it is often mounted separately from the antenna, on the same mast. Although the electronics could, of course, be brought inside the building and therefore removed from the detrimental environmental conditions, this is generally avoided since that would require a long length of cable transmitting signals at 2 GHz from the antenna to the electronics which could result in great electrical losses. Thus, it is generally preferred to maintain the frequency down converting electronics as close to the antenna as possible and transferring the signal at a lower frequency such as TV VHF frequencies in order to avoid such electrical losses. However, it is then necessary to provide a suitable housing for the electronics package so that it too can sustain the wind load and other detrimental environmental conditions. Nevertheless some electrical loss still exists since the electronics is nevertheless separate from the antenna.

In an MDS system, the reduction of as much losses as possible is of extra importance. The MDS transmitted signal passes through the atmosphere. The troposphere presents considerable difficulties for the MDS signal although it does not provide such difficulties to signals of lower frequency. The MDS signals may be absorbed or deflected by thermal inversions, free space loss, earth bulge, and objects blocking the signal path. Losses in signal strength caused by these tropospheric effects must be compensated for in the receiving system employed at each receiving location. Accordingly, heavy stress is placed on the reduction of losses in the receiving system. With the extra housing required for the electronics package, additional losses occur.

Another problem with the existing prior art type of antennas concerns the ability to achieve high gain. It is normally accepted that in order to achieve higher gain, large antenna size is required. While many cases will permit large dimension devics, in numerous applications the size is limited by the space available, the cost of the equipment, wind load tolerable and other factors.

It has been discovered that it is possible to achieve higher gain from the aforementioned type of antenna without increasing its size. In addition, a region is created directly within the antenna itself which may be used to contain the electronic circuitry. As a result, there is avoided the need for having an electronics package separate from the antenna, necessitating separate housing. Because only one housing is needed, the wind load is reduced, the transmission loss is reduced, the size of the antenna space is reduced since the electronics is directly contained within the antenna itself, and, surprisingly, the gain of the antenna itself is increased.

These benefits have been found to result from the inclusion of a metal structure within the waveguide portion. The only restrictions on this additional included metal structure area, that it must be spaced from the walls of the waveguide container, and that it must be contained within at most one half of the volume of the waveguide cavity. This volume being formed by cutting the waveguide cavity along its longitudinal axis. The probe which is utilized for exciting the waveguide section extends from the metal structure into the other half of the cavity and across the longitudinal axis for excitation of the waveguide itself.

Figure 4:
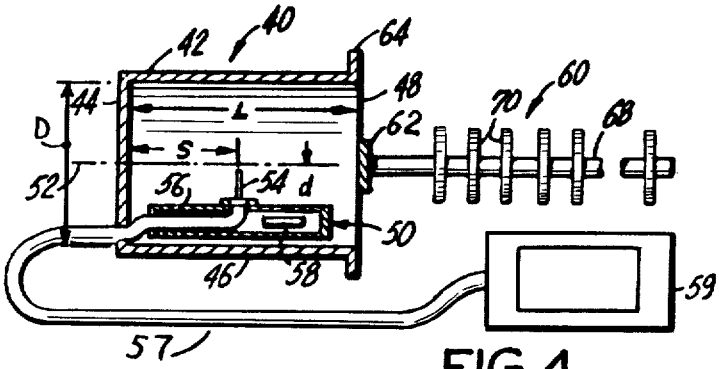
FIG. 4 is a sectional side elevational view of the disc-on-rod type antenna of the present invention, employing the improved probe excited open-end waveguide.
Figure 5:
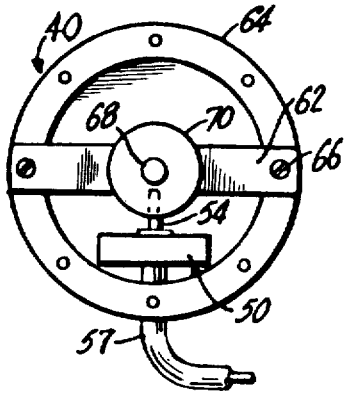
FIG. 5 is an end view of the antenna shown in FIG. 4.
Figure 6:
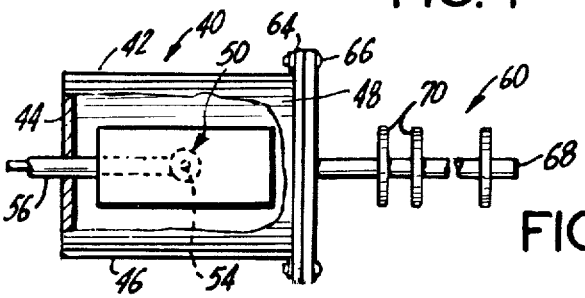
FIG. 6 is a bottom view of the antenna shown in FIG. 4, with part broken away.

More specifically, referring now to FIGS. 4 to 6, there is shown a waveguide section 40 formed of a cylindrical container 42 having a back wall 44, side walls 46, and an open mouth 48. Placed within the cylindrical container is a metal structure, shown generally as 50. The metal structure is shown as a rectangular hollow metal box. It is shown spaced from the side walls 46 and extends in a direction from the back wall 44 to the mouth 48. The metal structure is shown as being parallel to the axis of the antenna 52 and it is spaced below the axis by a distance d. Thus, the metal structure is contained within at most, one half of the volume of the waveguide and does not cross the center axis 52 of the container.

The probe 54 extends upwardly from and at right angles to the surface of the metal structure. The probe, which is an extension of the center conductor of the coaxial cable 57 may extend into the remainder of the container not having the metal structure. An electrical cable 56 shown as coaxial, passes within the metal structure toward the rear wall 44 of the container and leaves the container proximate the rear wall 44 and continues as the cable 57. Although it is shown at leaving directly from the rear wall, it could as well leave from a point adjacent thereto. However, since the metallic structure 50 must be isolated from the side walls, the probe cannot be electrically connected to the side walls.

Also included within the metal structure 50 is an electronics package, shown schematically as 58. When used as a receiving unit electronics package 58 could include the usual circuitry which would generally be placed outside of the antenna such as the preamplifier, down converter, etc. The output signal from device 58 can be fed to a utilization device 59 such as a television set, video recorder, or a TV camera. The coaxial cable 57 would then be connected between the output of electronics 58 and the input of the utilization device 59.

Connected to the waveguide section 40 is the disc-on-rod radiator 60 which is coupled by means of the support bar 62 connected onto the peripheral lip 64 by means of the nuts and bolts 66. The disc-on-rod radiator includes the center axial rod 68 supporting the spaced apart discs 70. The preferred spacing of the discs on the rod as well as the range of the diameter sizes are all as described before.

The waveguide section 40 is generally of a length L, and a major dimension or diameter D which is between $\lambda/2$ and $\lambda$. As is well known, when D is less than approximately $\lambda/2$ cutoff occurs, and with D greater than approximately $\lambda$ higher than the dominant mode can propagate. The distance between the probe 54 and the back wall is shown as distance S, and is well known to be optimally between $\lambda/8$ and $\lambda/2$ for best impedance match to the coaxial line. Thus, the length of the metal structure must be between the values S and L.

This length of metal structure extends in a direction between the back wall and the mouth. The metal structure can touch the back wall, if desired, and accordingly the back wall can be used for support of the metal structure holding in a cantilevered fashion within the metallic container. The metal structure should not extend past the mouth of the container. However, it should not touch the side walls of the waveguide container for best results. Preferrably it should clear it by at least at distance of $0.01\lambda$.

In the prior art, waveguides have been formed with metal structures in them. Such waveguides are well known as ridged waveguides. However, in such ridged waveguides, the internal metal structure must be in electrical contact with the side walls along the entire length. Furthermore, the inclusion of the metal structure to form a ridged waveguide is such as to modify the transmission signal so as to change the wavelength in the waveguide. In the present situation, the metal structure should not touch the side walls. Furthermore, it is found that it does not change the waveguide wavelength. Thus, the present metal structure does not perform in any manner like a ridged waveguide.

By the inclusion of the metal structure it would have been assumed that the gain of the antenna would, if anything be reduced since the dominant mode structure would be disturbed and the field would therefore not exist in the aperture region in the optimum form for radiation. However, it was discovered that the presence of the metal structure actually increased the gain. Thus, not only is there a benefit obtained in that there is provided room in the antenna for direct inclusion of the electronics package, but additionally, a gain occurs in the antenna itself.

It has further been found that the metal structure need not be a closed cylinder, but can actually be reduced to a single plate. Thus, the electronics package, as well as the coaxial transmission line, can be placed under the plate and still obtain the aforementioned benefits. Even utilizing this simple plate, the electronics is still isolated from the radiating portion by the metal plate, since it is in a region beyond the cutoff to the lowest waveguide mode. If a plate is used, the outer conductor of coaxial line 56 should be in contact with the plate.

Additionally, both the shape of the waveguide section as well as that of the metal structure need not be specifically as shown. The waveguide container can be of numerous shapes, not necessarily a circular cylinder, but e.g. a square or rectangular cylinder could be used. Furthermore, the metal structure can also be of numerous shapes, and in fact need not even be flat.

In a specific embodiment, a circular waveguide launcher of prior art construction was utilized of a size approximately 4 inches long by approximately 4 inches in diameter and a disc-on-rod radiator of about 35 inches long was provided with 32 discs, each 1¾ inches in diameter and 1 1/16 inches spaced apart. The diameter of the support rod was ⅜th inches. Working at a frequency of 2153 mHZ, it has been found that the gain was about 17¾ db above isotropic when the waveguide propagates the TE 11 mode excited by a coaxial line probe extending from the side of the waveguide about 2 inches from the closed end. This gain value was considered about maximum obtainable in the prior art for this size antenna at this frequency.

In accordance with this invention a metal structure was placed in the container spaced from the side walls. By placing the metal structure in the container, and with the probe extending from the surface of the metal structure into the container, the gain value was increased by at least ½ db to 18¼ db above isotropic. Furthermore, in addition to having the increased gain, a location was found directly inside the antenna cavity for placing an electronics package.

The exact reason why the metal structure improves the gain is not fully understood. It is noted that the metal structure and the cylinder in addition to the waveguide mode also forms a coaxial transmission system with the inner conductor being the metal structure which is eccentrically located with respect to the axis of the waveguide. Both systems are excited by another coaxial system, within or in contact with the metal structure, by means of the probe. It is difficult to analyze this complex structure especially as a radiating one. However, the measured result is an improvement in radiation efficiency. Furthermore, an internal housing is found for the electronics package which isolates the electronics from the radiating structure.

Not only was an increase in gain achieved when utilizing this structure as a launcher for a disc-on-rod radiator, however, an improvement in the gain was also found when utilizing the waveguide container itself as an elementary antenna without the disc-on-rod radiator. Although the gain improvement was less than occurred with utilizing it with the disc-on-rod radiator, nevertheless, an unexpected gain improvement did occur, compared to a predicted reduction, if anything. Furthermore, the benefit of providing the electronics directly in the antenna was still obtained.

Figure 7:
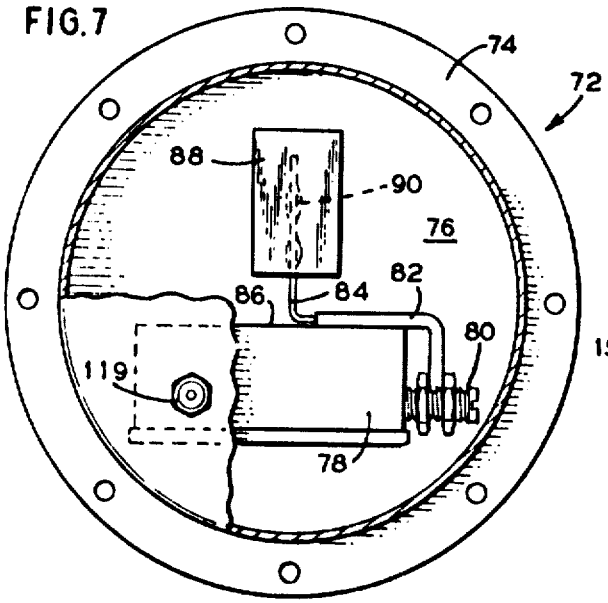
FIG. 7 is a partially sectioned rear elevational view of an antenna containing a downconverter and showing an improved exciting probe.
Figure 9:
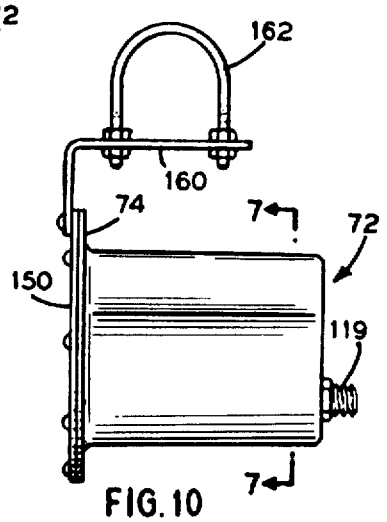
FIG. 9 is a side elevational view of the apparatus of FIG. 7.
Figure 8:
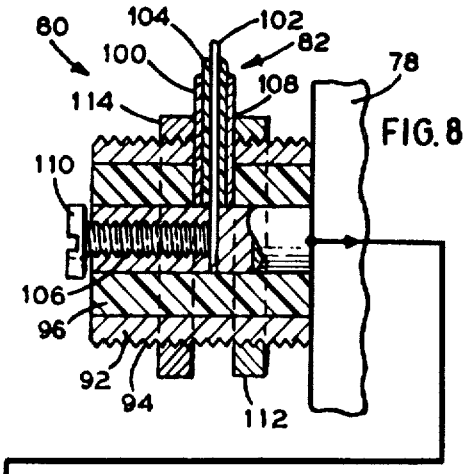
FIG. 8 is a sectional view taken through the coaxial connector of FIG. 7, and showing an improved connector to the exciting probe, and a block diagram of a typical down-converter and utilization circuit.

Referring now to FIGS. 7, 8 and 9, there is shown a preferred embodiment of the exciting probe utilized for excitation of the waveguide, as well as a unique interconnection between the exciting probe and the metal structure. In FIG. 7 the waveguide container is shown generally at 72 and includes the peripheral lip 74 surrounding the cylindrical container 76 which forms the antenna cavity. Located within the antenna cavity 76 is the metal structure 78 as was previously described. The exciting probe is connected by means of a coaxial connector 80 which is coupled to the side of the metal structure 78. A coaxial line 82 is electrically and mechanically connected to the coaxial connector 80. The center conductor 84 of the coaxial line 82 is bent upwardly from the top surface 86 of the metal structure 78 and is connected to a lightweight metal member 88, hereinafter referred to as a flag. The center connector 84 is shown interconnected to the flag by means of a solder joint 90. The flag is shown as being of rectangular configuration and is typically ½" to ¾" and about 0.010".

Generally, it is desired to have a probe of this large size for good impedance match on the other hand, it is preferrable to make it small in order to avoid detrimental effects due to shaking, dropping, and other means of damage by impact. However, by using a probe larger than a thin wire, there results the problem of increased mass of the probe. By soldering the lightweight flag onto the center conductor, we achieve the benefit of having the larger probe to avoid the possible damage during shipment and installation from shock caused by extra mass usually involved with a larger probe. This is achieved by using a lightweight flat metal plate soldered onto the wire. As a result, the low mass is not subject to handling shock which would normally bend the small diameter wire center conductor if it had to support a heavy mass. At the same time, the flag is suitably scaled to provide the necessary electrical requirements as needed for the proper probe to provide the needed bandwidth.

In order to interconnect the coaxial line 82, to the coaxial connector 80, a unique interconnecting arrangement is also produced. As can best be seen in FIG. 8, the coaxial connector 80 is shown enlarged and connected to the metal structure 78. The coaxial connector typically includes outer conductor 92 having an external thread thereabout 94 for coupling to another line. Inwardly of the outer conductor 92 is the insulating layer 96. At the center of the coaxial connector is the inner conductor 98.

The coaxial line 82 which is used for the probe includes its outer conductor 100, center conductor 102 and separating insulating layer 104.

In order to interconnect the coaxial line 82 to the coaxial connector 80, the inner conductor 98 of the connector 80 is drilled at least a portion therethrough to form the axial opening 106. A radial opening 108 is formed through a side of coaxial connector. The coaxial line 82 is then inserted through the radial opening 108 so that its center conductor 104 extends into the axial hole drilled out within the inner conductor 98. A lock screw 110 is then inserted into the axial opening 106 and serves as a set screw to hold the center conductor 104 within the inner conductor area of the coaxial connector 80. Suitable locking nuts 112 and a locking washer 114 are used to hold the coaxial line 82 securely to the coaxial connector 80.

The antenna as described together with suitable electronics package contained within the antenna can be used in an MDS system, either as the transmitting system or the receiving antenna. For example, when utilized in a receiving system, various electronic circuits would be utilized, as shown in FIG. 8. Specifically, in areas with sources of interferring signals such as radar installations following the antenna there may be included a preselector (not shown). This would then be followed by a preamplifier 121 whose purpose is to compensate for the mixer loss in the down converter and to make up for the path loss at distant receiving locations. A well designed preamplifier will have a low noise figure and will be sharply tuned to the incoming MDS frequency. This sharp tuning will help keep unwanted signals from entering the mixer 122 and producing unwanted products in the down converter output. The mixer 122 receives a signal from oscillator 126.

Following the down converter there is generally included an IF amplifier 128 whose purpose is to boost the signal from the mixer. This IF amplifier produces the necessary output to the TV receiver, 120. An output coaxial connector 119 permits attachment of a coaxial cable.

The power supply 132 utilized the standard household 120 V AC input rectifies and provides a voltage controlled 24 V to the down converter. A control box 140 generally located near the television set has circuitry which feeds DC power up the cable from the down converter and splits out the RF from the down converter. The power supply is generally well regulated and filtered to prevent overloads, brownouts, and noise from effecting the performence of the down-converter. In most cases, a matching transformer is utilized prior to the TV receiver.

The preselector is not always necessary but is advisable to avoid interference. It is formed of a sharply tuned band pass filter that allows the MDS signal to enter the down converter but attenuates all other frequencies.

Figure 10:
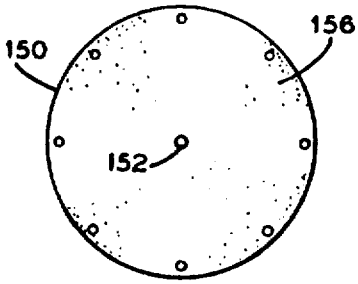
FIGS. 10 and 11 are front and rear elevational views of a radome utilized in the apparatus.
Figure 11:
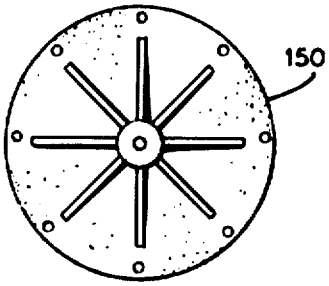
Figure 11:
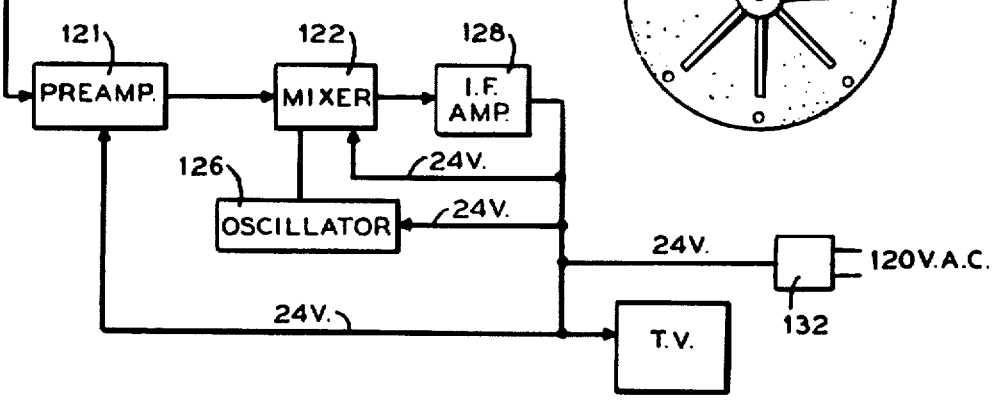

The metal cross-bar 62 may be replaced by a glass-filled synthetic resin plate 150, shown in FIGS. 9, 10 and 11. A threaded bore 152 may be provided to receive the threaded end of the disc-on-rod assembly.

Stiffening ribs 154 permit the use of a relatively thin plate 156 to minimize transmission losses. The plate may be secured to the cavity by conventional fasteners such as nuts and bolts. Bracket 160 and U bolt 162 are utilized for mounting the assembly to a mast.

Although a particular receiving system has been described, it is understood that a transmitting system could also be included where an up converter would be placed directly within the housing of the waveguide.

There has been disclosed heretofore the best embodiments of the present invention. However, it is to be understood that various changes and modifications may be made thereto without departing from the spirit of the invention.

I claim:

1. A microwave receiving apparatus comprising a probe excited, waveguide, electronic circuit means contained in said waveguide and means for mounting said waveguide onto a support; said waveguide comprising: a metallic container having an elongated axis and including at least a back wall, side walls, and and open mouth which defines an internal cavity; a metal structure positioned within the container and extending in a direction between the back wall and the mouth of the container, spaced from the side walls of the container and contained within at most one half of the volume of the cavity, and a probe extending from the metal structure into the remaining portion of the container for excitation of the waveguide; wherein the diameter D of the waveguide is between $\lambda/2$ and $\lambda$, the probe is spaced from the back wall a distance S of between $\lambda/8$ and $\lambda/2$, $\lambda$ being the wavelength of the transmission energy and wherein the metal structure extends from the back wall toward the mouth a distance in the range between S and the length L of the waveguide.

2. The apparatus of claim 1, and further comprising a plate-on-rod end-fire radiator element, having a radiating and a non-radiating end, coupled to the mouth of the container coaxial with said waveguide such that said probe excited waveguide acts as a launcher at said non-radiating end of said radiator element.

3. The apparatus as in claim 2, and further comprising a support member extending across the mouth of the container and axially supporting said radiator element from said container.

4. The apparatus as in claim 2, wherein said support member is conductive and is positioned perpendicular to the probe.

5. The apparatus as in claim 2, wherein said plate-on-rod radiator element has an axial conductive support rod, having a length of between $3\lambda$ and $12\lambda$, and a plurality of thin plates spaced between $0.16\lambda$ and $0.20\lambda$ along said rod, said plates lying in a plane containing the electric vector of the signal radiated by said launcher and the difference between the diameter of the plates and the diameter of the rod is greater than $0.23\lambda$ and less than $0.27\lambda$.

6. The apparatus as in claim 5, wherein said container is a circular waveguide launcher approximately 4 inches long by approximately 4 inches in diameter, said plate-on-rod radiator is approximately 35 inches long, having 32 discs each approximately 1¾ inches in diameter with a spacing between the plates of approximately 1 1/16 inches, said rod having a diameter of about ⅜th inch, and wherein the frequency of the transmitted signal is about 2 GHz.

7. The apparatus as in claim 1, wherein said probe comprises the center conductor of a coaxial line, and a lightweight, flat metal plate electrically coupled to said center conductor.

8. An MDS antenna system comprising a probe excited waveguide, comprising a metallic container having an elongated axis and including at least a back wall, side walls, and an open mouth which define an internal cavity; a metal structure positioned within the container extending in a direction between the back wall and the mouth of the container, spaced from the side walls of the container and contained within at most one half of the volume of the cavity, said half volume being formed by cutting the container along its elongated axis, and a probe extending from the metal structure into the remaining portion of the container for excitation of the waveguide, a frequency converter positioned within the at most one half of the volume of the cavity and separated from said remaining part of the container by said metal structure, and means for mounting said waveguide onto a support.

9. An MDS antenna system as in claim 8, wherein said frequency converter is a down converter, and whereby said system is a receiving system.

10. An MDS antenna system as in claim 8, wherein said frequency converter is an up converter, and whereby said system is a transmitting system.

11. An MDS antenna system as in claim 8, wherein the diameter D of the waveguide is between $\lambda/2$ and $\lambda$, the probe is spaced from the back wall a distance S of between $\lambda/8$ and $\lambda/2$, $\lambda$ being the wavelength of the transmission energy, and wherein the metal structure extends from the back wall toward the mouth a distance in the range of between S and the length L of the waveguide.

12. An MDS antenna system as in claim 8, and further comprising a plate-on-rod end-fire radiator element coupled to the mouth of the container such that said probe excited wave acts as a launcher at the non-radiating end of the radiator element.

13. An MDS antenna system as in claim 8, wherein said plate-on-rod radiator element has an axial conductive support rod, having a length between $3\lambda$ and $12\lambda$, and a plurality of thin plates spaced between $0.16\lambda$ and $0.20\lambda$ along said rod, said plates lying in a plane containing the electric vector of the signal radiated by said launcher and the difference between the diameter of the plates and the diameter of the rod is greater than $0.23\lambda$ and less than $0.27\lambda$.

14. An MDS antenna system as in claim 8, wherein the probe is coupled to a coaxial feed line which enters the container at a point proximate the back wall.

* * * * *